US011464331B2

(12) United States Patent
Klaus

(10) Patent No.: US 11,464,331 B2
(45) Date of Patent: Oct. 11, 2022

(54) PULL-OUT GUIDE

(71) Applicant: Paul Hettich GmbH & Co. KG, Kirchlengern (DE)

(72) Inventor: Stefan Klaus, Buende (DE)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 13 days.

(21) Appl. No.: 17/043,016

(22) PCT Filed: Mar. 22, 2019

(86) PCT No.: PCT/EP2019/057185
§ 371 (c)(1),
(2) Date: Sep. 29, 2020

(87) PCT Pub. No.: WO2019/197133
PCT Pub. Date: Oct. 17, 2019

(65) Prior Publication Data

US 2021/0015257 A1 Jan. 21, 2021

(30) Foreign Application Priority Data

Apr. 11, 2018 (DE) ..... 10 2018 108 647.4

(51) Int. Cl.
*A47B 88/427* (2017.01)
*A47B 88/407* (2017.01)

(52) U.S. Cl.
CPC ..... *A47B 88/427* (2017.01); *A47B 88/407* (2017.01)

(58) Field of Classification Search
CPC ..... A47B 88/427; A47B 88/407
See application file for complete search history.

(56) References Cited

U.S. PATENT DOCUMENTS 5,281,021 A * 1/1994 Rock ..... A47B 88/57 312/330.1
6,932,200 B2 8/2005 Booker et al.
7,320,508 B2 1/2008 Booker et al.
7,549,712 B2 * 6/2009 Booker ..... F16F 9/0218 312/333
10,362,871 B2 * 7/2019 Boekhoff ..... A47B 88/407
10,470,569 B2 * 11/2019 Chen ..... A47B 88/427
(Continued)

FOREIGN PATENT DOCUMENTS

CN 111820644 A * 10/2020
DE 202007001782 U1 * 1/2008 ..... A47B 88/427
(Continued)

OTHER PUBLICATIONS

International Search Report dated Apr. 29, 2019 issued in PCT/EP2019/057185 (with English Translation).
(Continued)

*Primary Examiner* — Hanh V Tran
(74) *Attorney, Agent, or Firm* — Collard & Roe, P.C.

(57) ABSTRACT

A pull-out guide has at least two rails that are movable relative to each other. A first attaching means for attaching a first pushing element is provided on a movable rail. A second attaching means at a distance from the first attaching means is provided on the movable rail for attaching a pushing element of a second drawer system. The pushing element of either the first or second drawer system can be attached to the movable rail.

14 Claims, 22 Drawing Sheets

(56) References Cited

U.S. PATENT DOCUMENTS

| | | | | |
|---|---|---|---|---|
| 10,499,736 | B2 * | 12/2019 | Chen | A47B 77/18 |
| 10,517,396 | B2 * | 12/2019 | Chen | A47B 88/477 |
| 11,013,320 | B2 * | 5/2021 | Meusburger | A47B 88/467 |
| 11,109,675 | B2 * | 9/2021 | Hayes | A47B 88/447 |
| 2003/0234603 | A1 * | 12/2003 | Salice | A47B 88/407 312/334.5 |
| 2004/0245898 | A1 * | 12/2004 | Amann | A47B 88/427 312/334.46 |
| 2009/0251037 | A1 * | 10/2009 | Berger | A47B 88/427 312/334.1 |
| 2011/0037366 | A1 * | 2/2011 | Lam | A47B 88/467 312/334.44 |
| 2012/0146476 | A1 | 6/2012 | Tibbe | |
| 2013/0249369 | A1 * | 9/2013 | Gasser | A47B 88/423 312/334.32 |
| 2014/0055020 | A1 * | 2/2014 | Gasser | A47B 88/427 312/333 |
| 2014/0175965 | A1 * | 6/2014 | Salice | A47B 88/427 312/334.1 |
| 2014/0314347 | A1 * | 10/2014 | Huang | A47B 88/407 384/22 |
| 2016/0198855 | A1 * | 7/2016 | Liang | A47B 88/427 248/241 |
| 2016/0242543 | A1 * | 8/2016 | Mohr | A47B 88/407 |
| 2017/0095080 | A1 * | 4/2017 | Chen | H05K 7/1489 |
| 2017/0105525 | A1 * | 4/2017 | Klaus | A47B 88/427 |
| 2017/0135476 | A1 * | 5/2017 | Chen | A47B 88/407 |
| 2019/0298059 | A1 * | 10/2019 | Chen | A47B 77/18 |
| 2021/0015256 | A1 * | 1/2021 | Ruech | A47B 88/443 |

FOREIGN PATENT DOCUMENTS

| | | | | | |
|---|---|---|---|---|---|
| DE | 202007001782 | U1 | | 1/2008 | |
| DE | 102010017639 | A1 | | 12/2011 | |
| DE | 102015106873 | A1 | * | 11/2016 | A47B 88/407 |
| DE | 102017121845 | A1 | * | 3/2019 | A47B 88/427 |
| DE | 102018108646 | A1 | * | 10/2019 | A47B 88/427 |
| EP | 421458 | A | * | 4/1991 | |
| EP | 1622485 | A2 | | 2/2006 | |
| EP | 2636339 | A1 | * | 9/2013 | A47B 88/427 |
| WO | WO-2008028809 | A1 | * | 3/2008 | A47B 88/427 |
| WO | WO-2010037683 | A1 | * | 4/2010 | A47B 88/427 |
| WO | 2012082737 | A2 | | 6/2012 | |
| WO | WO-2012149586 | A1 | * | 11/2012 | A47B 88/57 |

OTHER PUBLICATIONS

German Search Report dated Nov. 26, 2018 issued the corresponding German Application No. 10 2018 108 647.4 (with English translation of relevant parts).

* cited by examiner

PULL-OUT GUIDE

CROSS REFERENCE TO RELATED APPLICATIONS

This application is the National Stage of PCT/EP2019/057185 filed on Mar. 22, 2019, which claims priority under 35 U.S.C. § 119 of German Application No. 10 2018 108 647.4 filed on Apr. 11, 2018, the disclosures of which are incorporated by reference. The international application under PCT article 21(2) was not published in English.

BACKGROUND OF THE INVENTION

The present invention relates to a pull-out guide comprising at least two rails that are movable relative to each other, wherein a first attaching means for attaching a first pushing element is provided on a movable ran, and a drawer with a pull-out guide.

For attaching a drawer to a pull-out guide, it is known from DE 20 2007 001 782 U to attach an outer coupling part to one end face of a running rail. The outer coupling part has a hollow body section into which a shaped part of an adapter can be inserted. This type of drawer attachment has proved successful in itself, but the connecting means on the drawer are exactly matched to the outer coupling part on the pull-out guide, and it is not possible to attach different drawer systems to the pull-out guide.

DE 10 2010 017 639 discloses a piece of cabinet furniture with a pull-out section in which a running rail of a pull-out guide has in each case an open longitudinal slot at its front end. This allows the drawer to be fixed to the running rail with connecting means and lifted upwards for disassembly. This attachment of the drawer also has the disadvantage that only a single drawer system can be fitted to the pull-out guide.

SUMMARY OF THE INVENTION

It is therefore the object of the present invention to create a pull-out guide which is designed to be more variable with regard to the attachment of different drawer systems.

This object is solved with a pull-out guide with the features of claim 1.

In the pull-out guide according to the invention, a first attaching means and a second attaching means are provided on the movable rail, each of which is designed for attaching a pushing element, wherein either a first or a second pushing element can be optionally fastened to the movable rail, wherein the first and the second pushing elements are different pushing systems. The provision of first and second attaching means on the movable rail means that the pull-out guide can be used in a more versatile manner, in particular different drawer systems can be mounted on the movable rail.

The drawer systems can essentially be divided into four main groups of drawer systems. The different drawer systems are shown as examples in FIGS. 19A to 19D.

The first group of drawer systems comprises those drawers that are mounted on a pull-out guide 40 using a so-called push-on assembly (FIG. 19D). As a rule, pull-out guide 40 has at least one vertical pin 41 in the front area of the movable rail of pull-out guide 40, which projects into a receptacle of drawer 42. This group is defined as a push-on drawer system.

The second group of drawer systems (FIG. 19A) comprises those drawers in which at least the drawer rail of the pull-out guide 101 projects into the frame 102. The frame 102 is usually a construction composed of several metallic components, which has a cavity to accommodate at least the upper part of the pull-out guide 101. The frame 102 can be of various designs and can also have other materials, e.g. glass, as a decorative element. This drawer is usually assembled by sliding it on, wherein a connecting element is arranged in the frame 102 in the front area of the frame to connect the frame 102 in the cavity to the pull-out guide 101. This group is defined as a system drawer system.

The third group of drawer systems comprises those drawers in which a frame 111 is positioned on the side next to a pull-out guide 110 and the drawer bottom 112 is positioned above the pull-out guide 110, as shown in FIG. 19C. The frame 111 is usually a construction composed of several metallic components. The frame 111 can be constructed in various ways and can also have other materials, e.g. glass, as a decorative element. This drawer is usually assembled by sliding it on, wherein a connecting element is arranged on the frame 111 in the front area of the frame 111 in order to connect the frame 111 to the pull-out guide 110. This group is defined as an underfloor system drawer system.

The fourth group of drawer systems comprises those drawers in which a frame 121 is positioned laterally next to the pull-out guide 120 and the drawer bottom 122 above the pull-out guide 120, as shown in FIG. 19B. The frame 121 is generally made of wood or another profile material, although the frame 21 can also be a construction composed of several metal components. The frame 121 can be of different construction and can also have other materials, e.g. glass, as a decorative element. This drawer is usually assembled by sliding it on. The essential feature here is that a separate manually mounted coupling unit 123 must be fitted to the drawer in the front area below the drawer bottom 122 to establish the connection to the pull-out guide 120. The frame 121 itself does not have a connection interface in the front area for connection to the pull-out guide 120. This group is defined as an underfloor drawer system.

Preferably, the first and second attaching means are arranged on different sides of a movable rail of the pull-out guide, for example on sides that are at an angle to each other. It is also possible to arrange them on opposite sides of the rail in order to be able to attach attaching means of different drawer systems at different positions on the rail.

In a further design, the first and second pushing elements are designed as different drawer systems which differ from each other at least in the area of the connecting interface or connecting means. A first type of pushing element comprises connecting means arranged on the frame, for example an adapter, and the first pushing element may have a hollow side frame formed by covers, for example of plastic or a metal sheet. However, the frame may also be formed from solid material, for example plastic, with integrated connecting means. The second type of pushing element comprises a connecting means which can be subsequently arranged, preferably detachably, on a region of the pushing element and may have side walls made of a solid material, in particular of a wood-based material or plastic. The second connecting means may, for example, comprise a coupling unit which can be fastened by screws or latching. This means that different drawer systems can be attached to one and the same pull-out guide.

The first and/or second attaching means may include at least one projection which is formed integrally with the rail. The projection may be in the form of an angled web or dome-shaped elevation to provide a means of fixing a connecting means to a pushing element. Alternatively or additionally, the first and/or second attaching means may comprise at least one recess on the movable rail, preferably a continuous opening on the rail. The first and second attaching means may have different geometries.

The first and/or second attaching means may either be formed integrally with the rail or be provided on an additional component, in particular an add-on part which at least partially engages in the rail or is otherwise attached. For example, the add-on part is designed as a plug located at the front end of the rail or as an insert element on lateral surfaces of the rail, as is discloses, for example, in the locking insert in EP 1 622 485, to which reference is hereby made.

The first and second pushing element can be mounted on a rail without tools, in particular by means of a latching, or clamping or locking mechanism. Different couplings can be used to fix the respective pushing element to the rail.

if a first pushing element is fixed to the first attaching means, the second attaching means is preferably not occupied, i.e. there is no engagement with a connecting means of the pushing element at the second attaching means. Conversely, when a second pushing element is fixed to the second attaching means, the first attaching means is not occupied.

The invention is explained in more detail below by means of several exemplary embodiments with reference to the attached drawings, wherein:

BRIEF DESCRIPTION OF THE DRAWING FIGURES

DETAILED DESCRIPTION OF THE INVENTION

Figure 1:
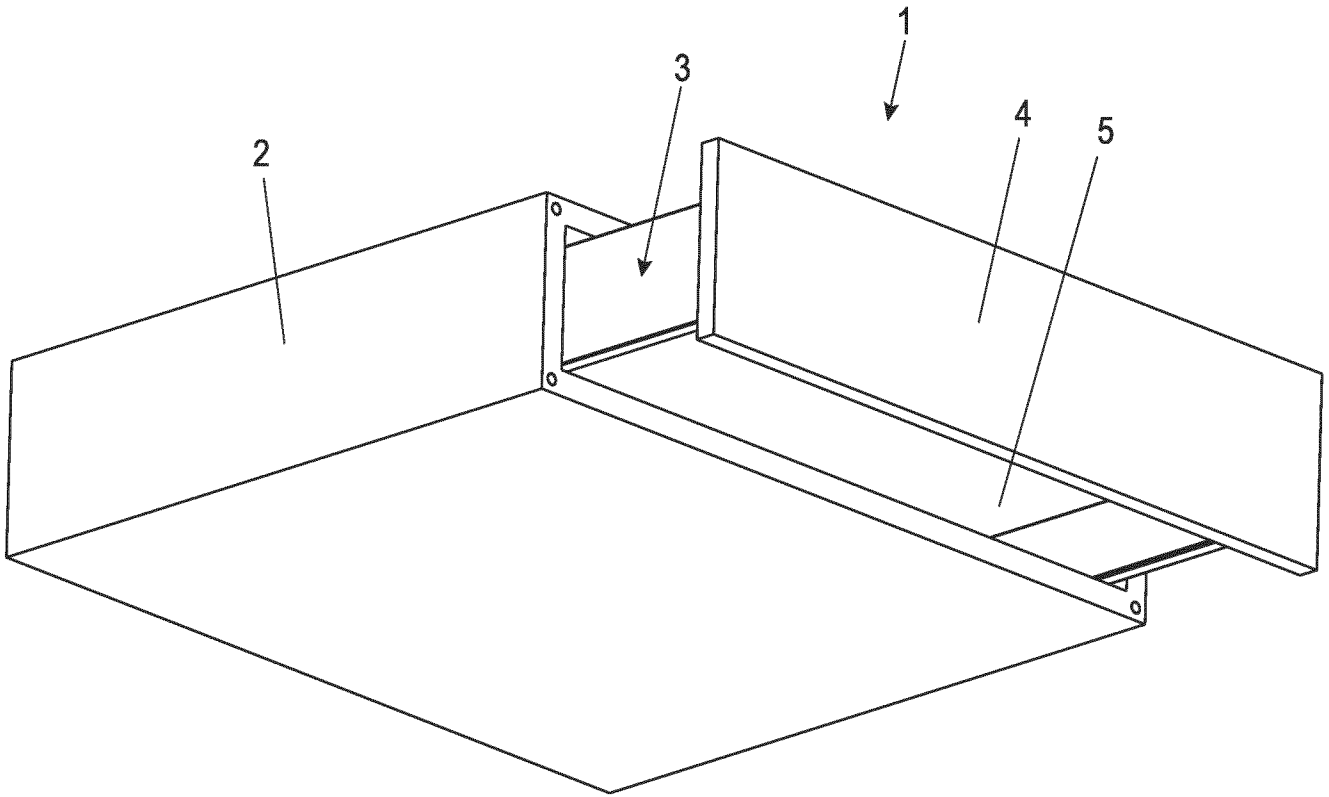
FIG. 1 shows a perspective view of a piece of furniture with a pushing element.
Figure 2:
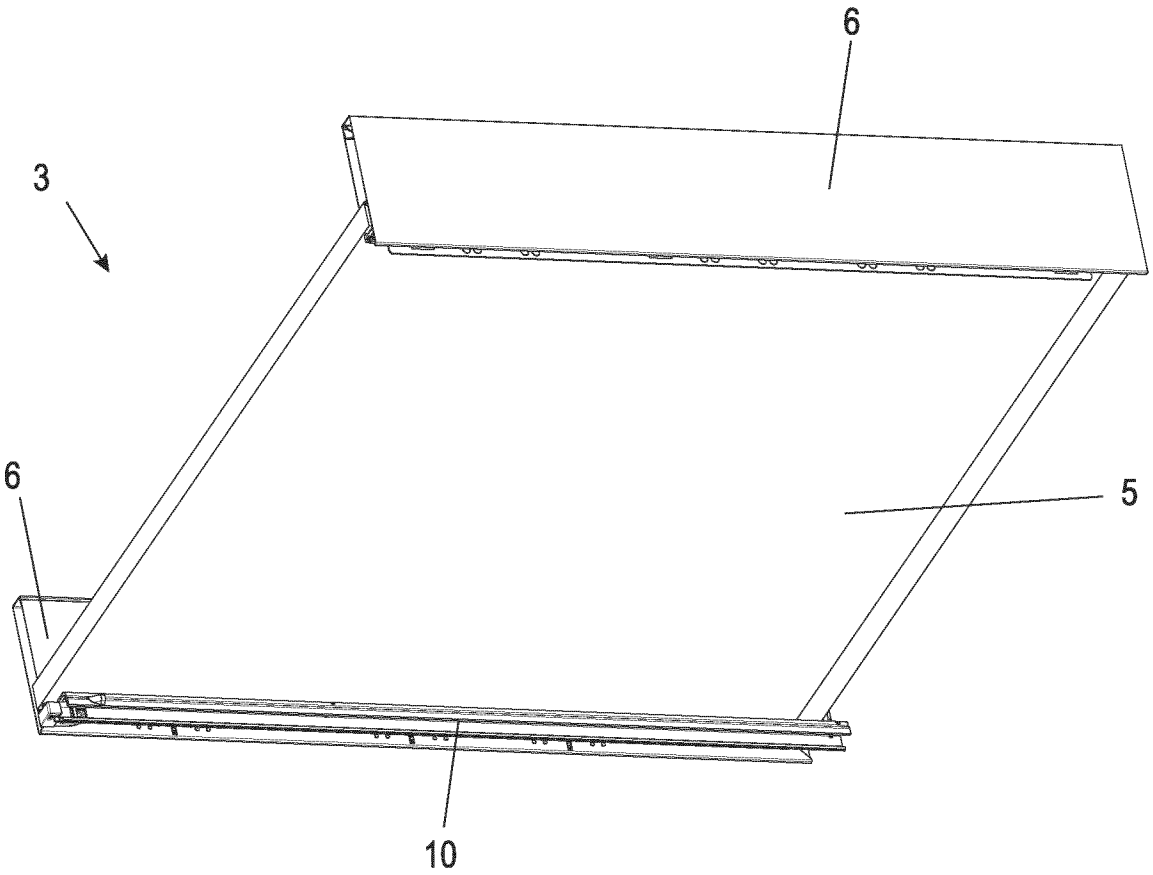
FIG. 2 shows a perspective view of the pushing element of FIG. 1.

FIG. 1 shows a piece of furniture 1 with a schematic representation of a furniture body 2, on which a pushing element 3 in the form of a drawer is movably mounted. The pushing element comprises a front panel 4, which is arranged outside or inside the furniture body 2. In FIG. 2, the pushing element 3 is shown without front panel 4, and it comprises a base 5 on which side frames 6 are provided on opposite sides. In the area of the base 5, a rail 10 of a pull-out guide 8 is also shown, which is connected to the pushing element 3. This pushing element 3 is an underfloor system drawer system.

Figure 3:
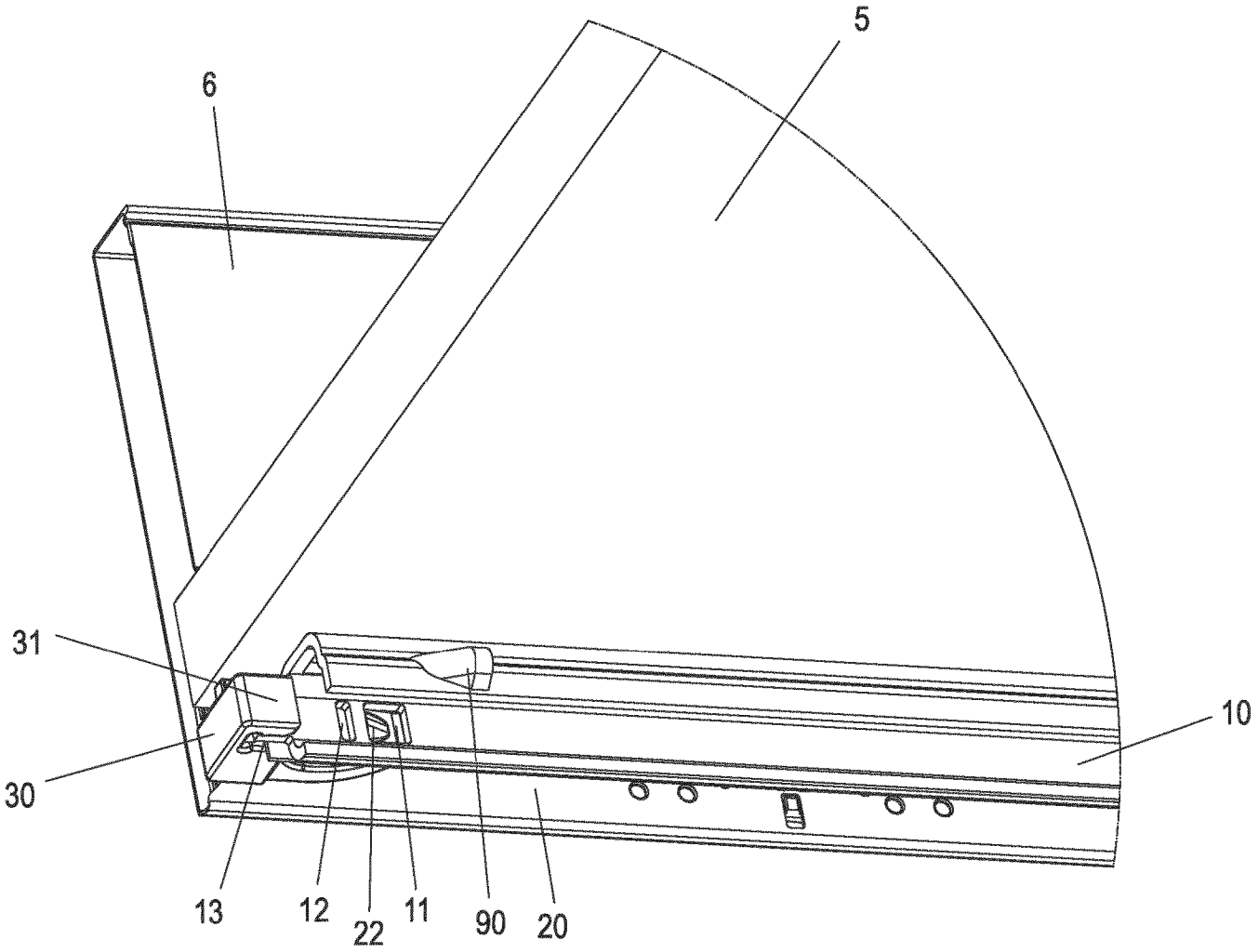
FIG. 3 shows a perspective view of the device for attaching the pushing element of FIG. 1 in the mounted position.

As shown in FIG. 3, two adjacent latch receivers 11 and 12 are formed on rail 10, which are arranged next to each other in a longitudinal direction of rail 10. The latch receivers 11 and 12, which are designed as openings, are of different sizes, wherein a first latch receiver 12 in a longitudinal direction of rail 10 is shorter than a second latch receiver 11. However, both latch receivers 11, 12 can also be of the same length, or the first latch receiver 12 can be longer than the second latch receiver 11. In the second latch receiver 11 there is a latching projection 22, which limits movement of the rail 10 relative to an adapter 20.

The adapter 20 is designed as a frame adapter and accommodates at least one profile of a side frame 6, which can be designed in one or more parts. The side frame 6 can have several adapters 20, wherein the adapter 20 facing the front panel 4 carries the latching projection 22.

The adapter 20 can also be designed as a continuous adapter 20, so that the adapter 20 corresponds approximately to the length of the side frame 6. The front adapter 20 may have one or more receptacles for mounting the front panel 4. Further functional elements may be provided on the adapter 20, e.g. devices for attaching the base 5 or elements for sliding or latching a side frame wall.

Figure 4:
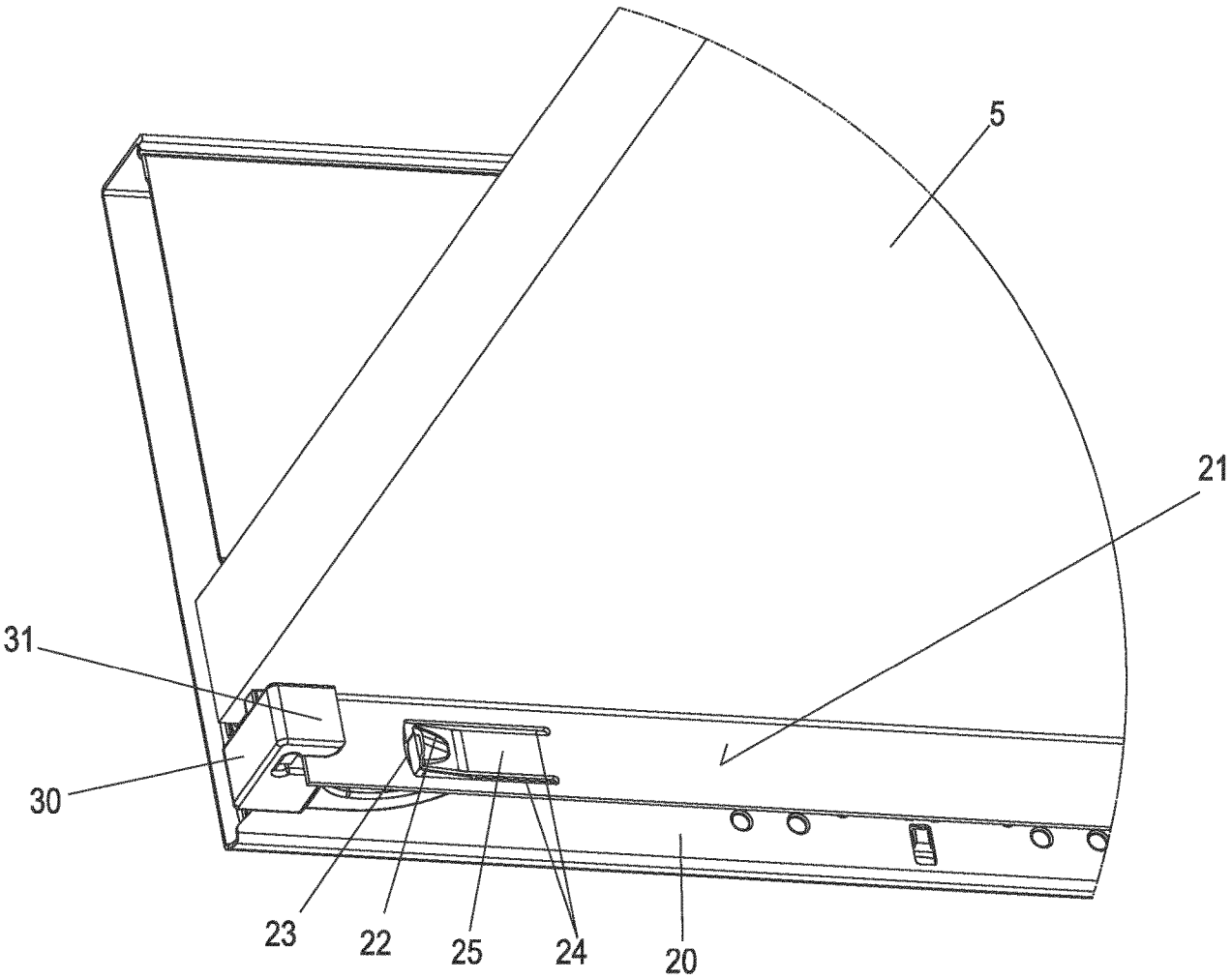
FIG. 4 shows a perspective view of the device of FIG. 3 without rail.

In FIG. 4, the rail 10 has been omitted and it can be seen that the adapter 20 forms a contact surface 21 against which the rail 10 rests with one surface, wherein a latching projection 22 projects from the contact surface 21, which is separated from the adapter 20 by a slot 23 transverse to the longitudinal direction and two slots 24 in the longitudinal direction of the rail 10, wherein a spring web 25 is formed between the two slots 24, which is formed integrally with the adapter 20. The slots 23 and 24 embrace the latching projection 22 in a Li-shape and thus ensure that the latching projection 22 can move perpendicularly to the contact surface 21. The adapter 20 is a component of the side frame 6 and forms the connecting means.

Figure 5:
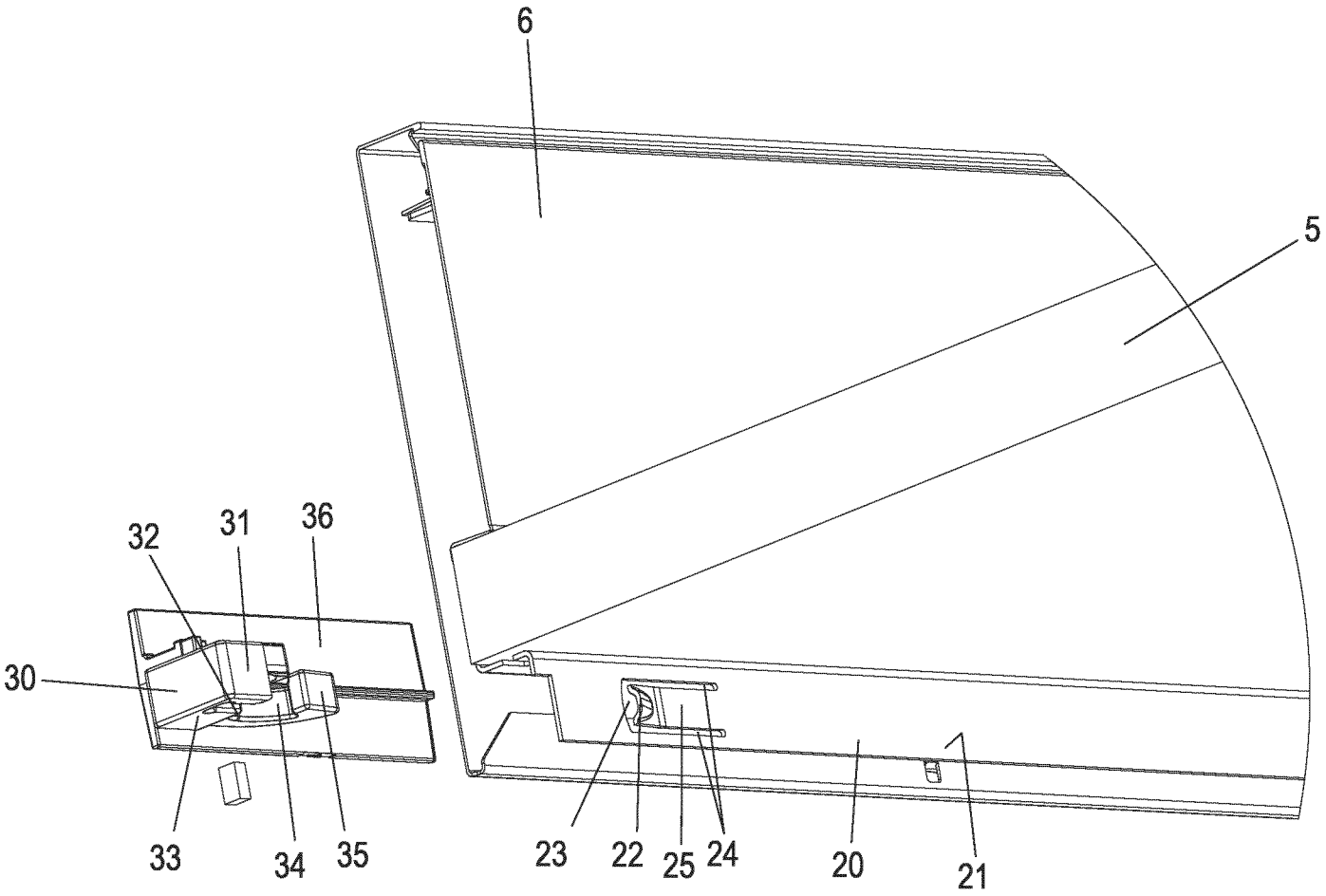
FIGS. 5 to 7 show several exploded views of the device for attaching a pushing element before assembly.
Figure 6:
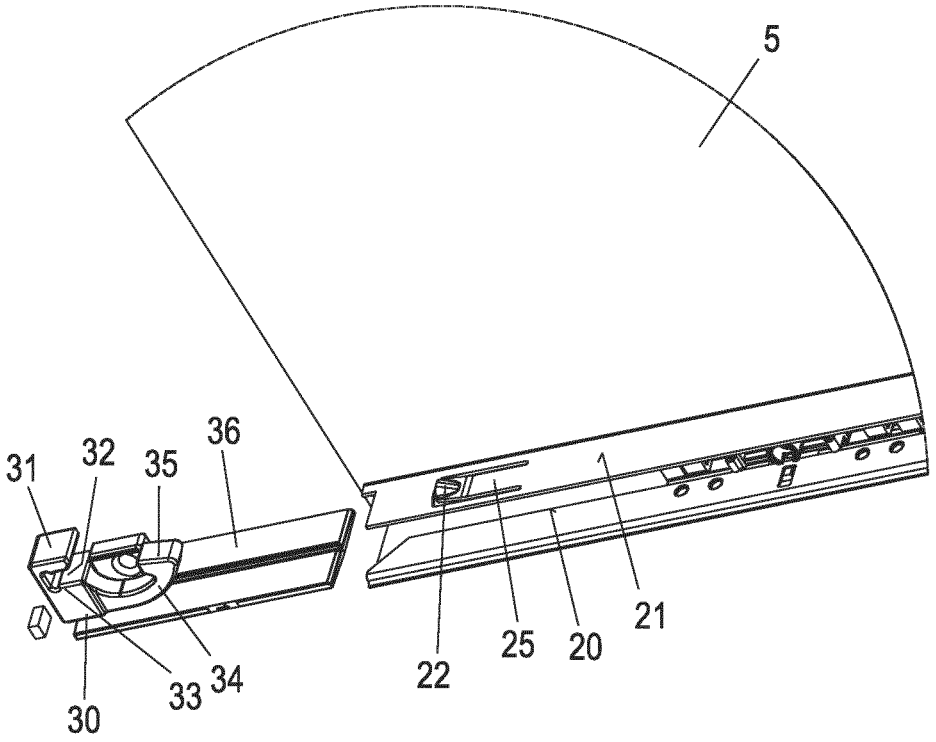
Figure 7:
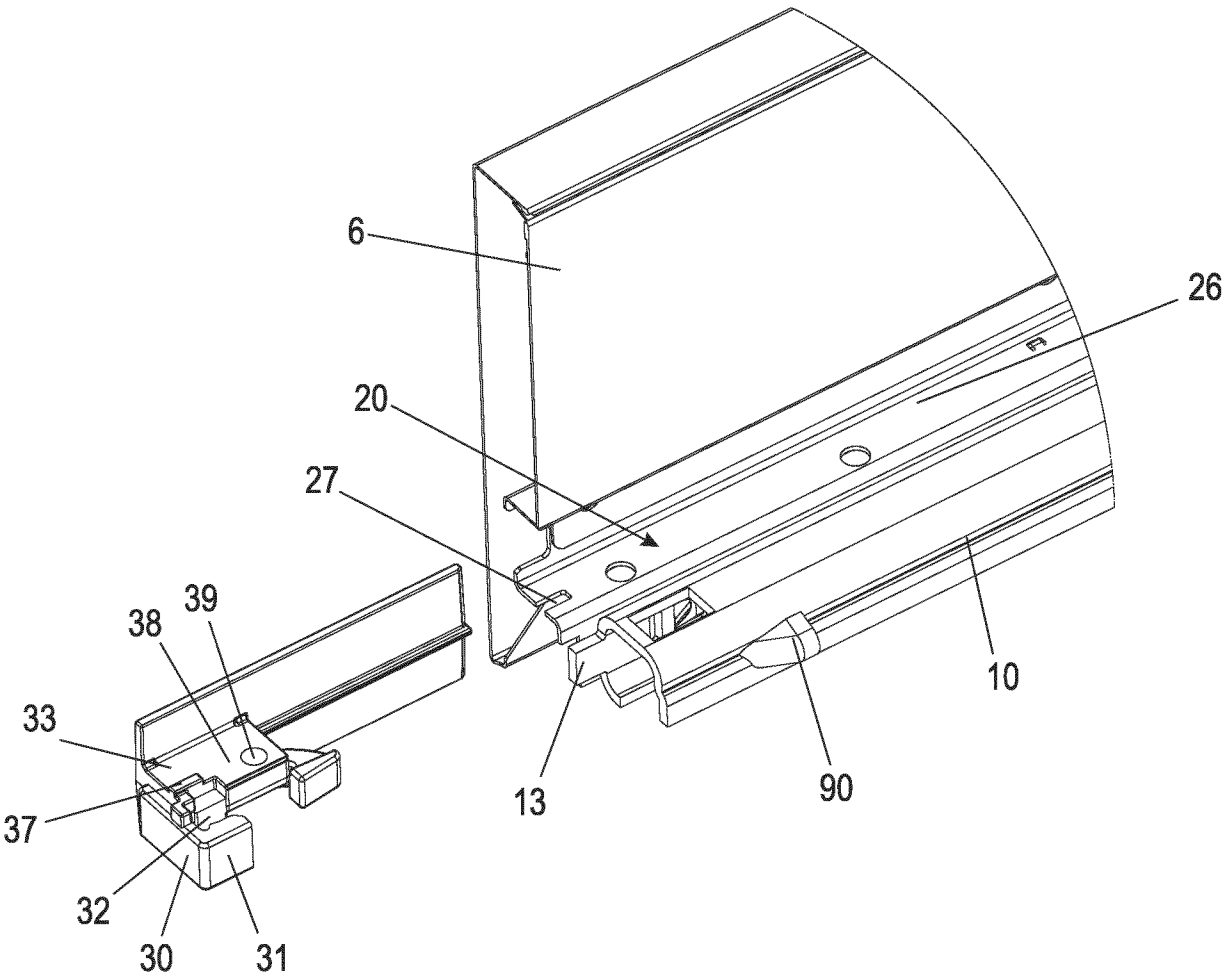

The strip-shaped adapter 20 is connected at the end to a holder 30, which has a receptacle for inserting one end of the adapter 20, and an arm 31 embraces this end. The holder 30 is designed as an additional component, as shown in the exploded view in FIG. 5. The holder 30 comprises a slot-shaped receptacle 32 for insertion of one end of the adapter 20 and one end of the rail 10. The slot-shaped receptacle 32 is surrounded on one side by the arm 31 and on the opposite side by a block 33. On the block 33, a counterholder 34 is provided, which supports the spring web 25 with a support section 35, so that the holder 30 supports the latching projection 22 when the latter is pivoted out of the plane of the contact surface 21. A wall section 36 is also formed on the holder 30, which can be inserted into an opening in a side frame 6 of the pushing element 3. For mounting, the wall section 36 is inserted until one end of the strip-shaped adapter 20 engages in the slot-shaped receptacle 32 of the holder 30. As shown in FIGS. 6 and 7, the rail 10 also has a front web-shaped end 13 which can be inserted into the slot-shaped receptacle 32 together with the end section of the adapter 20. The web-shaped end 13 of rail 10 is open at the top so that the arm 31 is not hindered by any part of rail 10 when the pushing element 3 is lifted. The holder 30 also has an optionally provided, upwardly protruding projection 37 on the block 33, which can be inserted into a recess 27 on the adapter 20. Optionally, the holder 30 can also be fixed to the adapter 20 by means of an attaching means which is inserted into an opening 39 on a web 38.

In the illustrated exemplary embodiment, the adapter 20 is also used to attach the base 5 of the pushing element. To attach the base 5, the adapter 20 has a groove-shaped receptacle 26 into which an edge section of the base 5 can be inserted.

Figure 8:
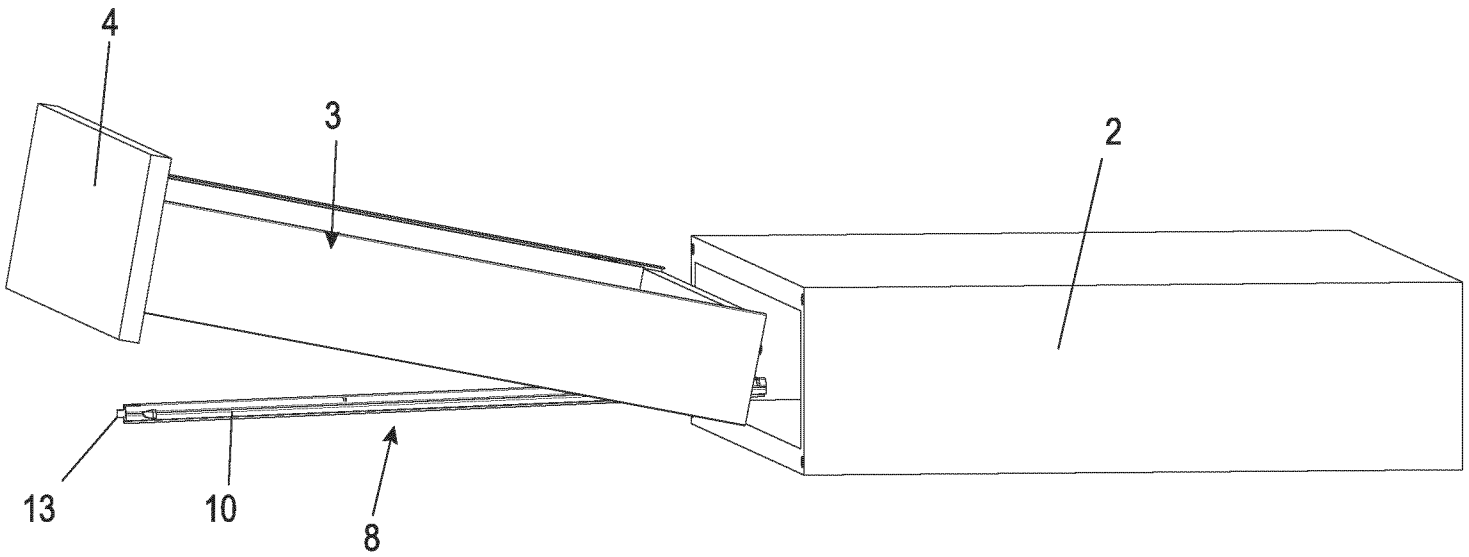
FIG. 8 shows a perspective view of the piece of furniture of FIG. 1 when dismantling the pushing element.

In order to be able to release the pushing element 3 after mounting it on the rail 10 of the pull-out guide 8, the pushing element 3 is first moved into an opening position. Then the pushing element 3 can be lifted in the region of the front panel 4 as shown in FIG. 8. When raised, the latching projection 22 slides over the latch receiver 11 on the rail 10 and can thus cause unlocking between the pushing element 3 and rail 10.

In FIGS. 1 to 8 the pushing element 3 is fastened via the latch receiver 11, which is designed as an opening and in which the latching projection 22 engages in the mounted position. Thus, the frame adapter 20 with its latching projection 22 represents a first connection interface, in this exemplary embodiment, the connection between rail 10 and pushing element 3 is made on the outside of the rail 10, looking at the pushing element 3 from the front when assembled. The latch receiver 11 is thus a first attaching means for attaching a pushing element, which in this exemplary embodiment has a hollow side frame 6 on which one or more adapters 20 are provided in the longitudinal direction of the rail 10. On the rail, on the side opposite the latch receiver 11 in this example, a latching projection 90 is formed, which forms a second attaching means to which a further pushing element can be attached, for example a drawer with a side wall made of a solid material such as wood. This latching projection 90 has no function in FIGS. 1 to 8, as only the latch receiver 11 is in engagement with the adapter 20. However, the latching projection 90 can be used for a further pushing element, as explained below. Several latching projections or one or more latch receivers may also be formed on the opposite side.

Figure 9:
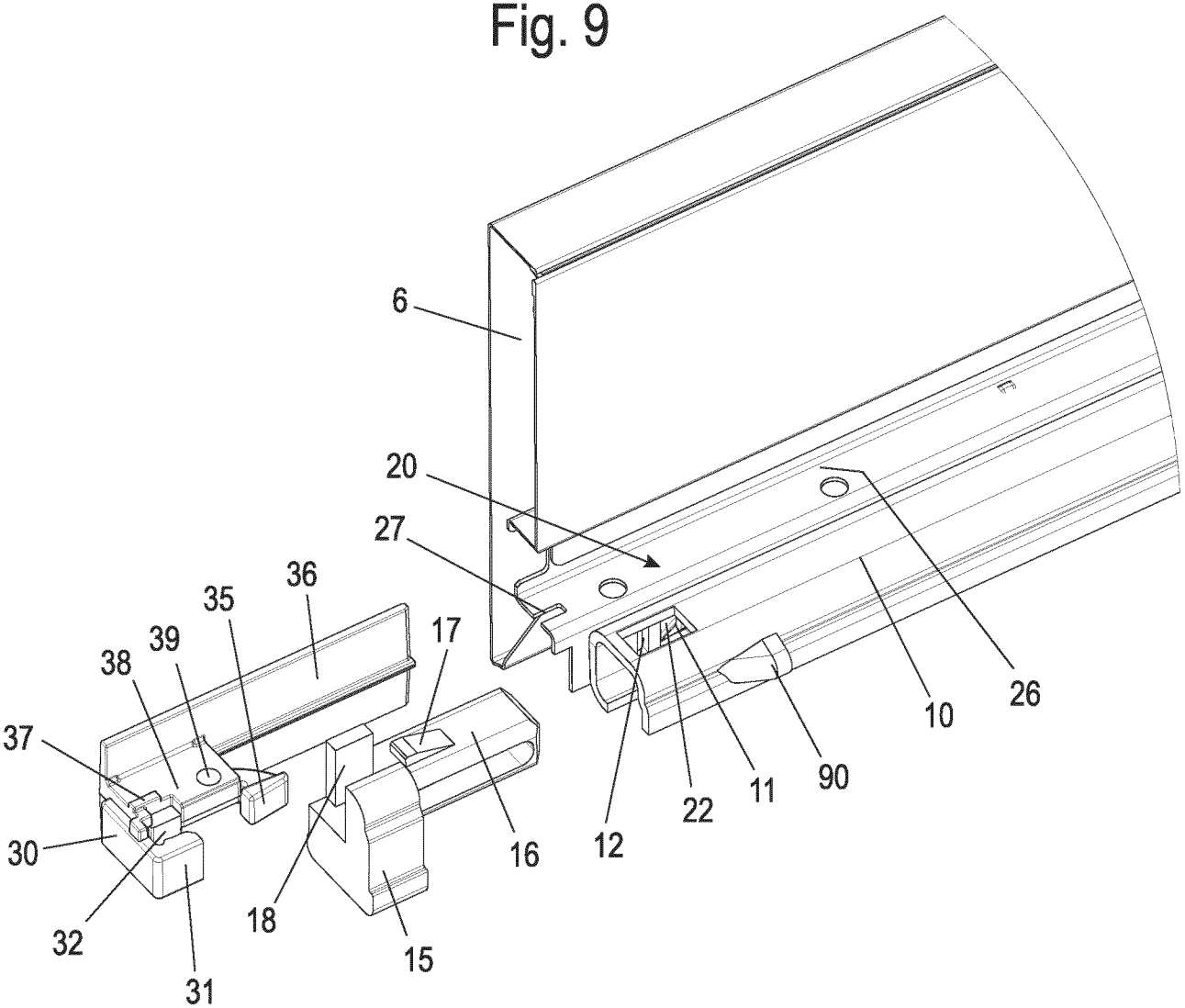
FIG. 9 shows a perspective exploded view of a modified device for attaching a pushing element.
Figure 10:
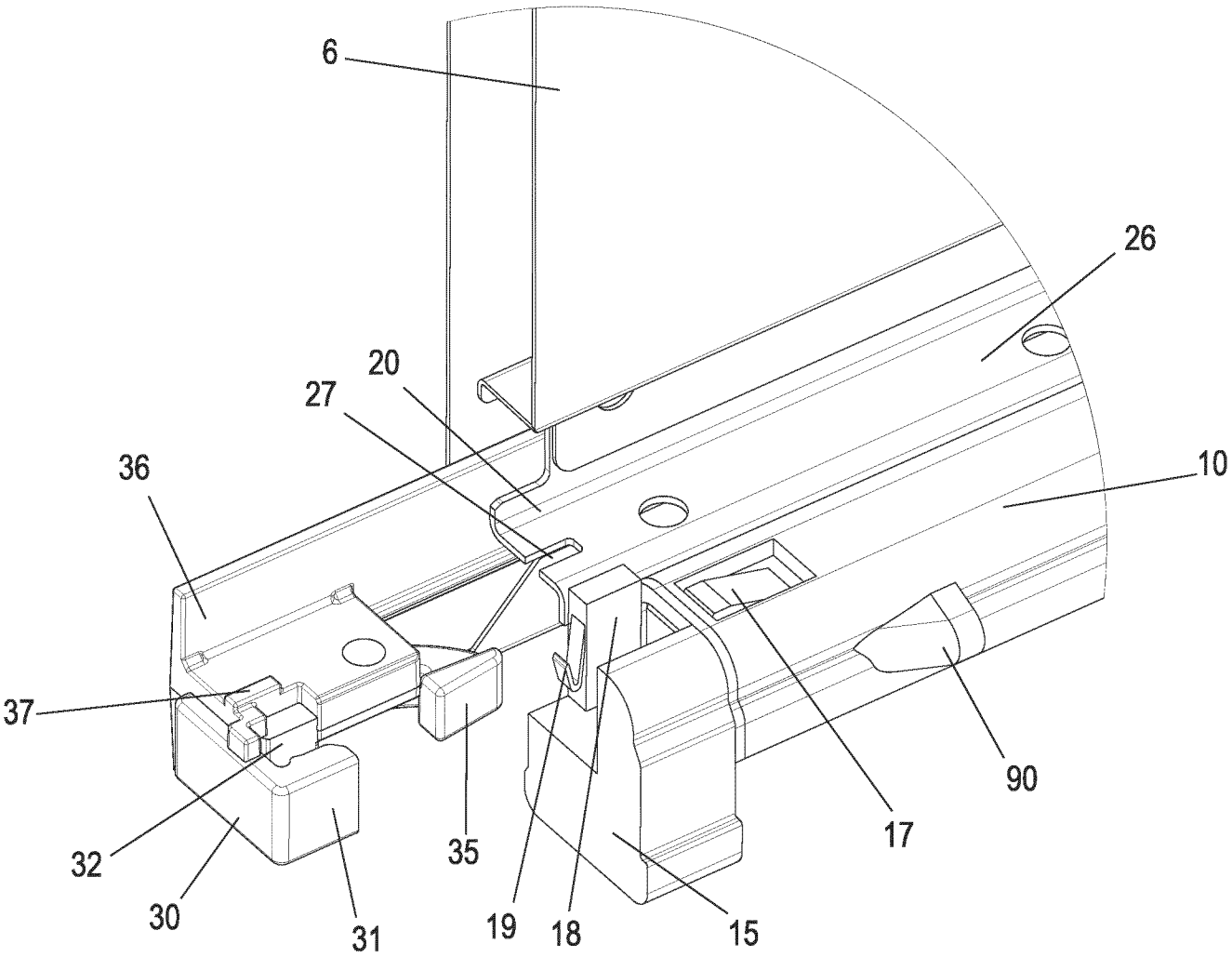
FIG. 10 shows a perspective view of the device of FIG. 9 during assembly.
Figure 11:
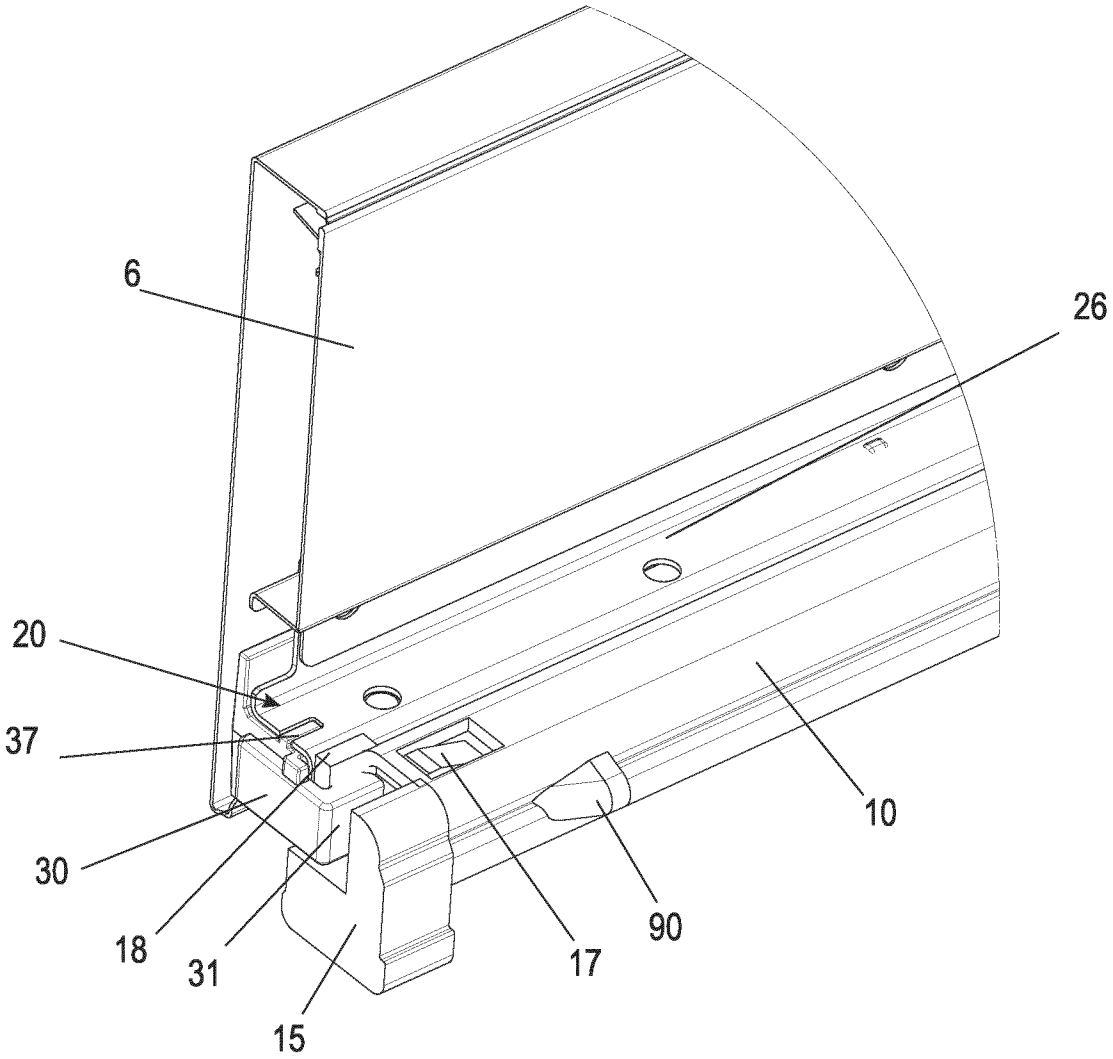
FIG. 11 shows a perspective view of the device of FIG. 9 in the mounted condition.

FIGS. 9 to 11 show a further exemplary embodiment of a device for attaching a pushing element 3, in which, in contrast to the previous exemplary embodiment, rail 10 is not held directly on holder 30, but a plug 15 is provided as an attachment part which is mounted on rail 10. The plug 15 comprises a strip-shaped section 16 which can be inserted into the curved rail 10. The strip-shaped section 16 has a latching projection 17 which can be inserted into an opening in the rail 10. The latching projection 17 can be located on the top of the section as shown. A web 18 is formed on a head section of the plug 15 projecting from the rail 10, which engages in the slot-shaped receptacle 32 of the holder 30. The area of the web 18 on the plug 15 is designed to be open at the top so that the arm 31 is not obstructed by a part of the rail 10 or the plug when the pushing element 3 is lifted off.

As can be seen from the enlarged illustration in FIG. 10, a spring element 19 can be provided on the web 18, which is supported at one front end of the slot-shaped holder 32 and thus pretensions the holder 30 away from the rail 10 in the longitudinal direction of the rail 10.

The plug 15 can also be equipped with the latch receivers 11,12 to attach the adapter 20 to the plug 15 via the latching projection 22. In addition or alternatively, the plug 15 could also have at least one latching projection 90 on the side opposite to the web 18 or the latch receivers 11,12 for the possibility of connection to a pushing element with another connection interface, for example a coupling device which can be retrofitted to the pushing element.

In the mounted position shown in FIG. 11, the web 18 is inserted together with an end section of the adapter 20 into the slot-shaped receptacle 32, and the projection 37 is inserted into the recess 27 on the adapter 20. Otherwise, the latching projection 22 engages in the latch receiver 11 as in the first exemplary embodiment. In this exemplary embodiment, too, the latching projection 90 has no function when rail 10 is used with this pushing element 3 and has no connection to pushing element 3.

Figure 12:
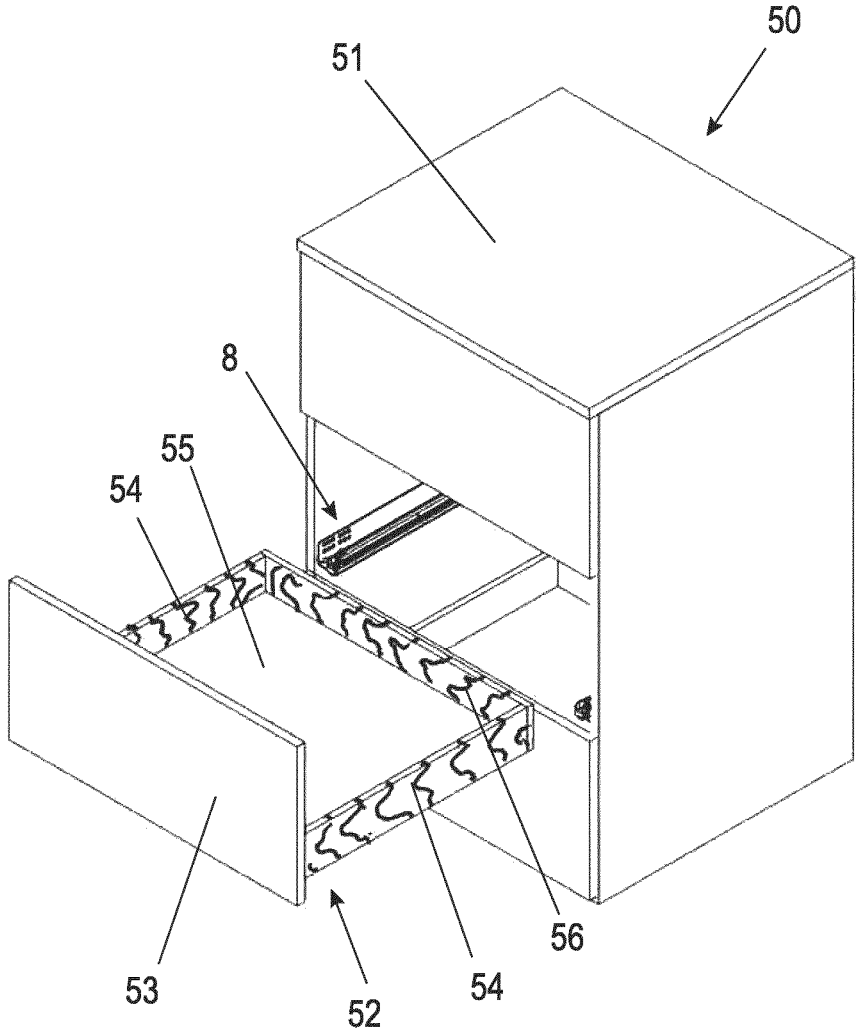
FIG. 12 shows a perspective view of a piece of furniture with a second pushing element.

FIG. 12 shows a piece of furniture 50 which has a furniture body 51 on which several pushing elements 52 are held in a displaceable manner. For this purpose, pull-out guides 8 are provided on opposite sides of a pushing element 52, on which the pushing element 52 is movably held. The pushing element 52 is designed as a drawer which comprises a front panel 53, side walls 54, a base 55 and a rear wall 56. The side walls 54 and the rear wall 56 are provided with a schematic grain as shown in the diagram in order to illustrate the formation of the side walls 54 and the rear wall 56 from a solid material, in particular from a wood-based material. This pushing element 52 is an underfloor drawer system.

Figure 13A:
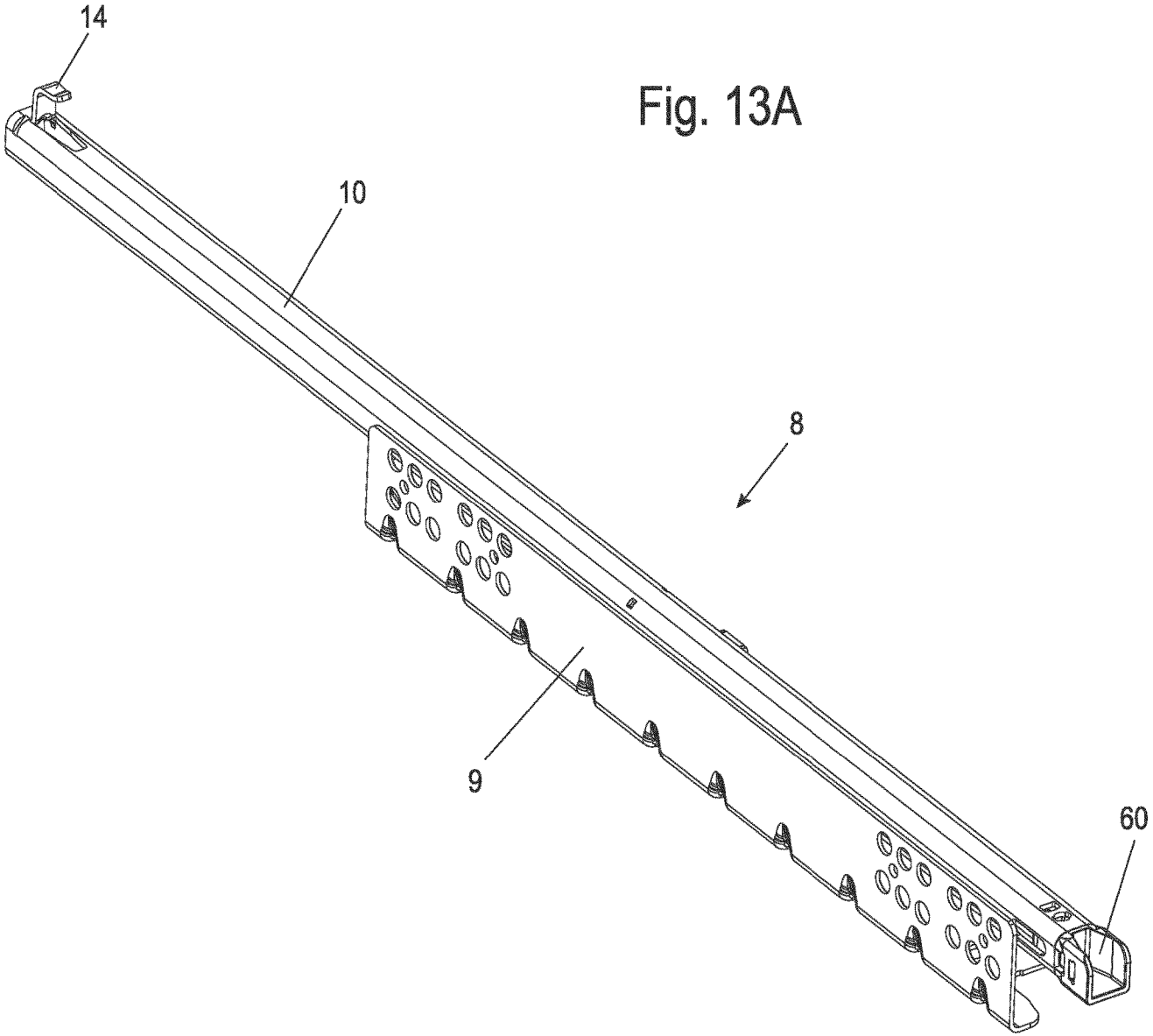
FIGS. 13A and 13B show two views of a pull-out guide for mounting the second pushing element of FIG. 12.
Figure 13B:
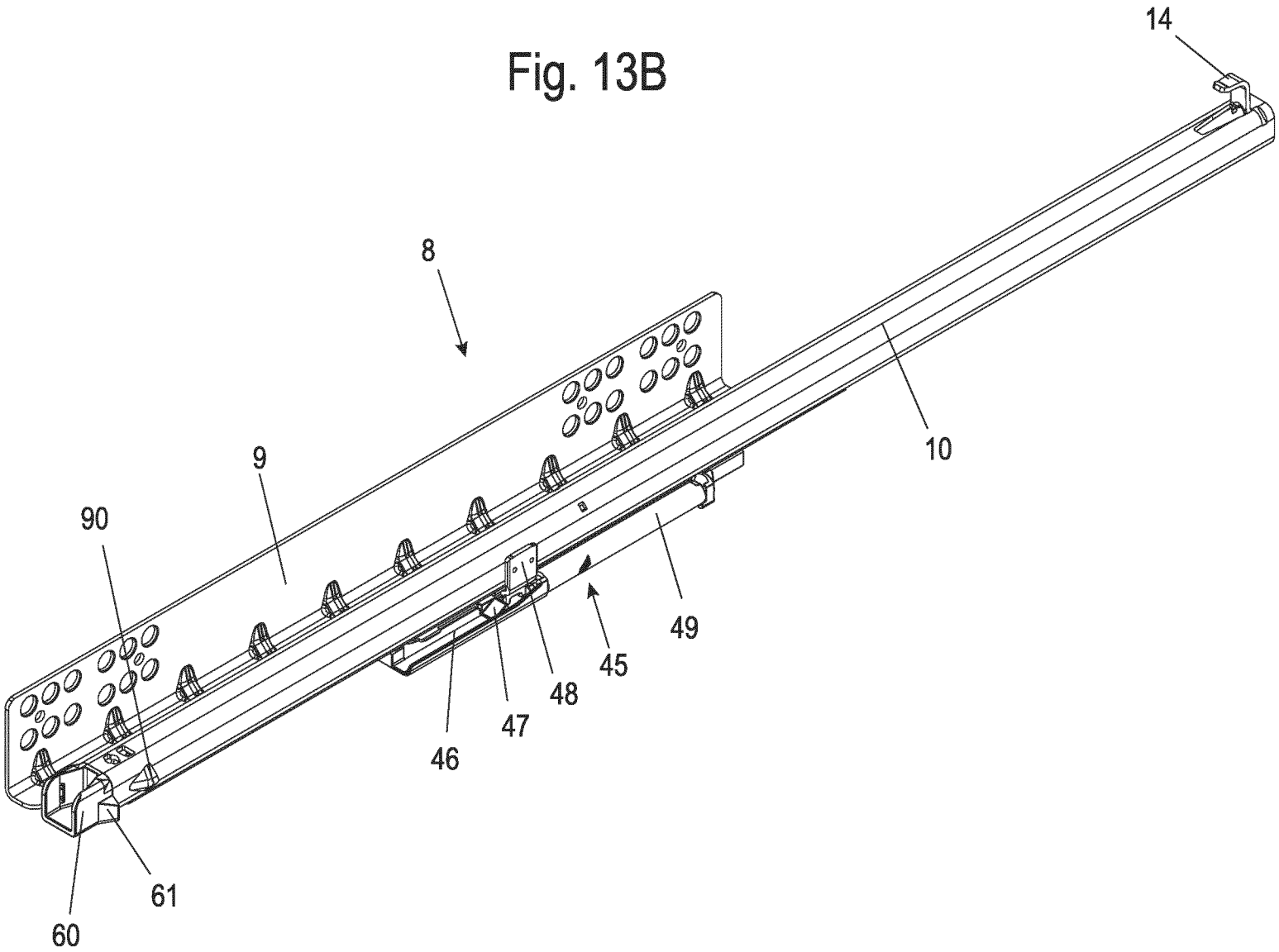

FIGS. 13A and 13B show a pull-out guide 8, which has a guide rail 9 and can be attached to a furniture body 51. Relative to the guide rail 9, the rail 10 can be moved and serves to hold the pushing element 52. The rail 10 includes an optional hook 14 on the rear side by means of which the pushing element 52 can be fixed to the rear wall 56, for example through an opening in the rear wall 56.

The pull-out guide 8 also includes a self-closing mechanism 45, which has a guide element 46 for a driver 47 that can be coupled to an activator 48 that is fixed to the rail 10. The driver 47 can be preloaded to a retracted position by means of an energy storage device in a cartridge 49 in order to hold the pushing element 52 in a closed position via the coupling with the activator 48. The self-closing mechanism 45 can also have a damper to brake the pushing element 52 during a closing movement. Optionally, another or an additional drive mechanism can be provided on the pull-out guide 8, for example an ejecting device.

At a front end of rail 10, a plug 60 is provided as an add-on part, which has a laterally protruding latching projection 61. In the assembled position, the latching projection 61 protrudes towards an interior space on the furniture body 51.

The attachment of the pushing element 52 to the rail 10 of the pull-out guide 8 is explained below with reference to FIGS. 14 to 16. The element 52 is placed with the base 55 on the rails 10, with connecting means 62 being provided underneath base 55 for attaching pushing element 52 to rail 10. Each connecting means 62 comprises a housing mounted on the base 55 and/or the front panel 53, on which a spring web 63 with a guide bevel 64 is formed. On the spring web 63, a first latch receiver 65 and an adjacent latch receiver 66 are provided. The connecting means 62 is a so-called coupling unit, which is manufactured separately and is only connected to the pushing element 52 after it has been assembled, preferably detachably, e.g. by means of screws. The connection interface or the connecting means of the pushing element 52 is different from the connection interface or the connecting means of the pushing element 3 of the first two exemplary embodiments according to FIGS. 1 to 11. In the exemplary embodiment according to FIGS. 12 to 16, the connection between rail 10 and pushing element 52 is made in the assembled state on the inside of rail 10 looking at the pushing element 52 from the front.

The pushing element 52 is placed on the two rails 10 in such a way that the end plug 60 is positioned at a distance from the front panel 53. Then the pushing element 52 can be moved in the closing direction on the rails 10 as shown in FIG. 15. When the pushing element 52 is moved, the plug 60 with the latching projection 61 comes into contact with the guide bevel 64 of the spring web 63 and pushes it inwards until the latching projection 61 engages with the first latch receiver 65.

Figure 16:
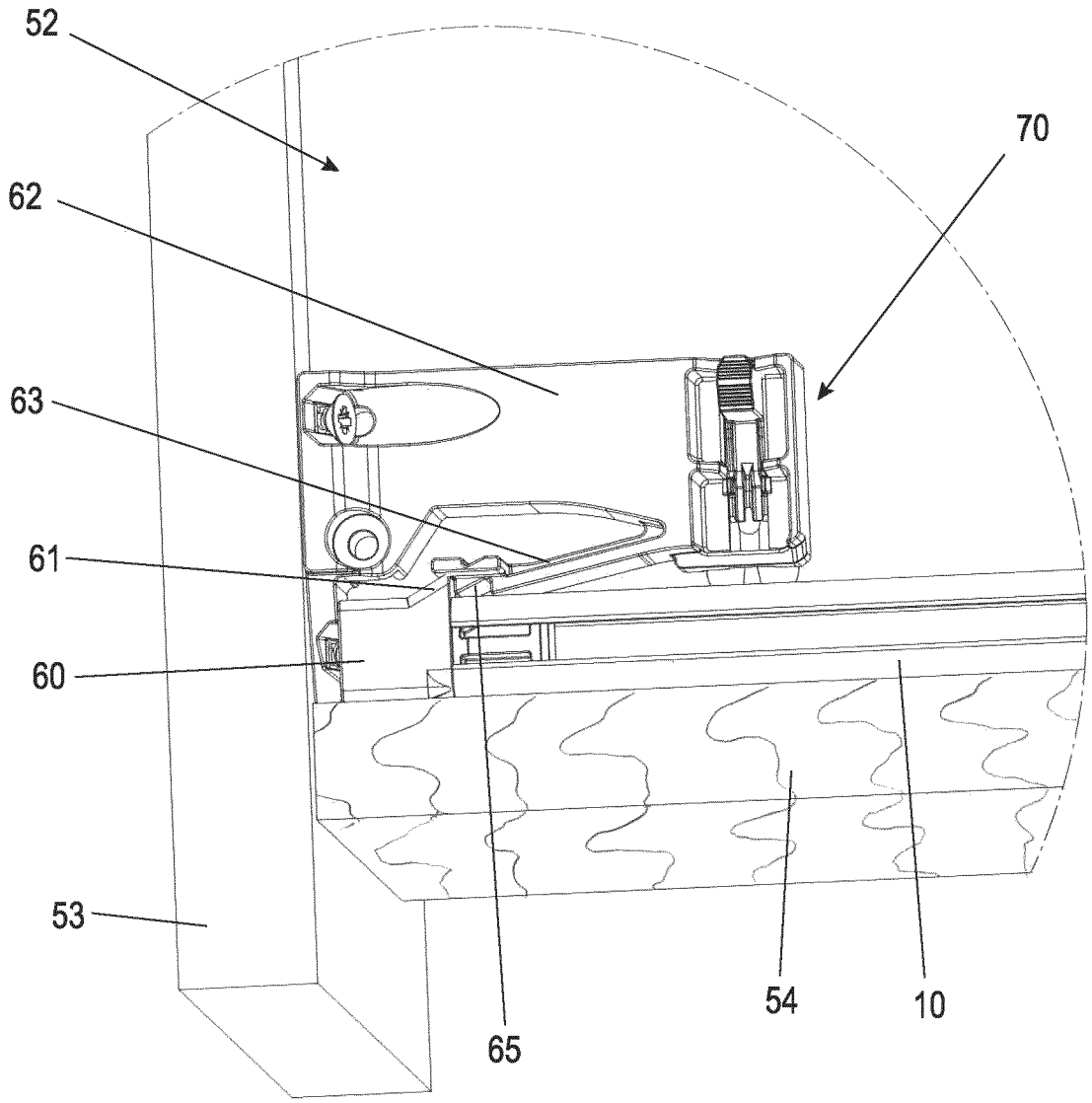
FIG. 16 shows a detailed view of the connecting means of FIG. 14 after assembly.

For complete assembly, the pushing element 52 is then pushed in further in the closing direction, optionally also after a previous pull-out movement, in order to engage the latching projection 61 in the second latch receiver 66, as shown in FIG. 16. The pushing element 52 is now in the assembled position, in which pulling on the front panel 53 transmits a force to the latching projection 61 and thus to the rail 10. On the housing of the connecting means 62, adjusting means 70 can also be provided to adjust the position of the front panel 53 in the height direction and/or in the lateral direction and/or in the depth. Such adjusting means 70 can therefore move the pushing element 52 relative to the rail 10 in at least one spatial direction.

Figure 14:
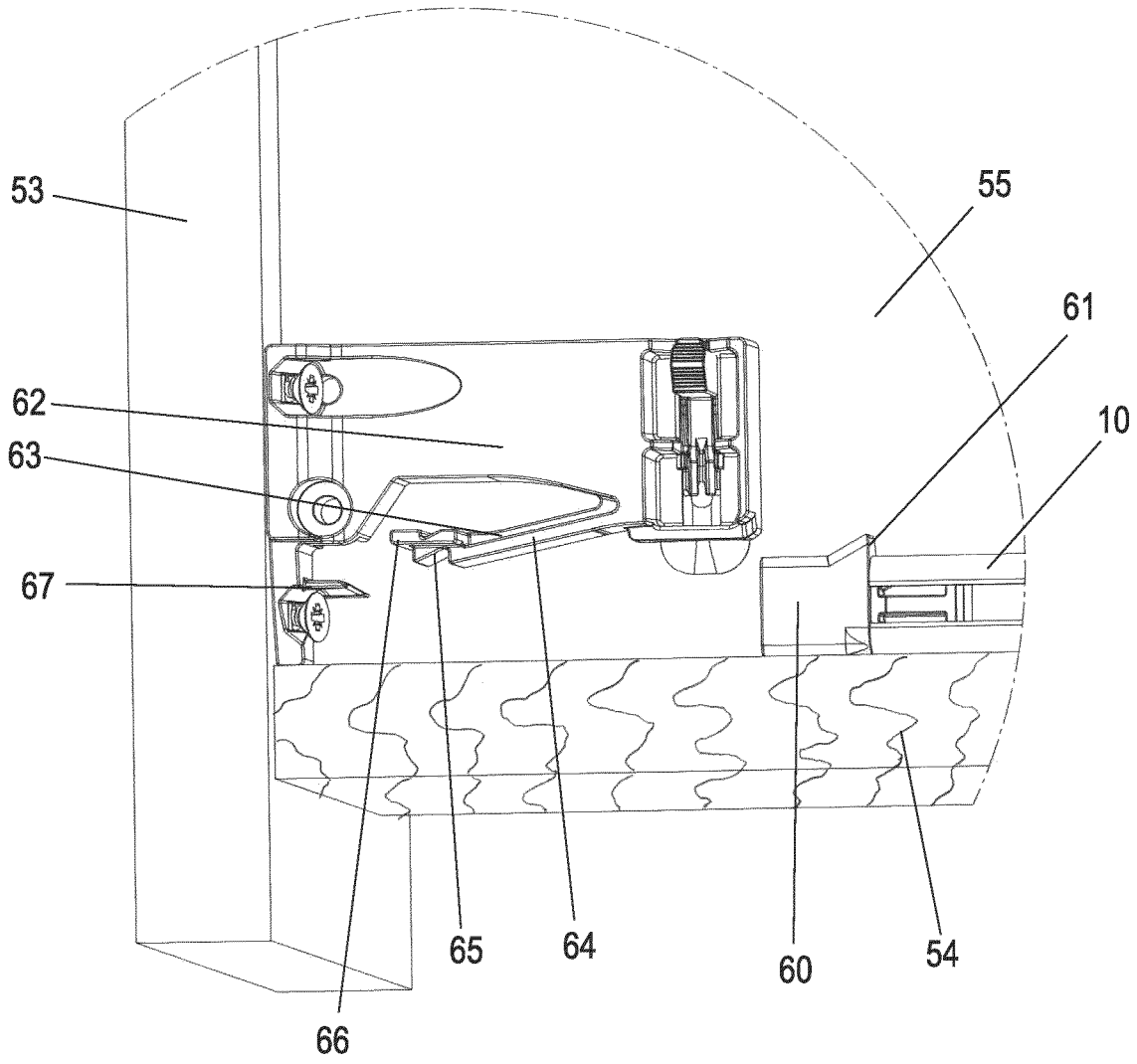
FIG. 14 shows a detailed view of the connecting elements for attaching the pushing element to the pull-out guide before assembly.
Figure 15:
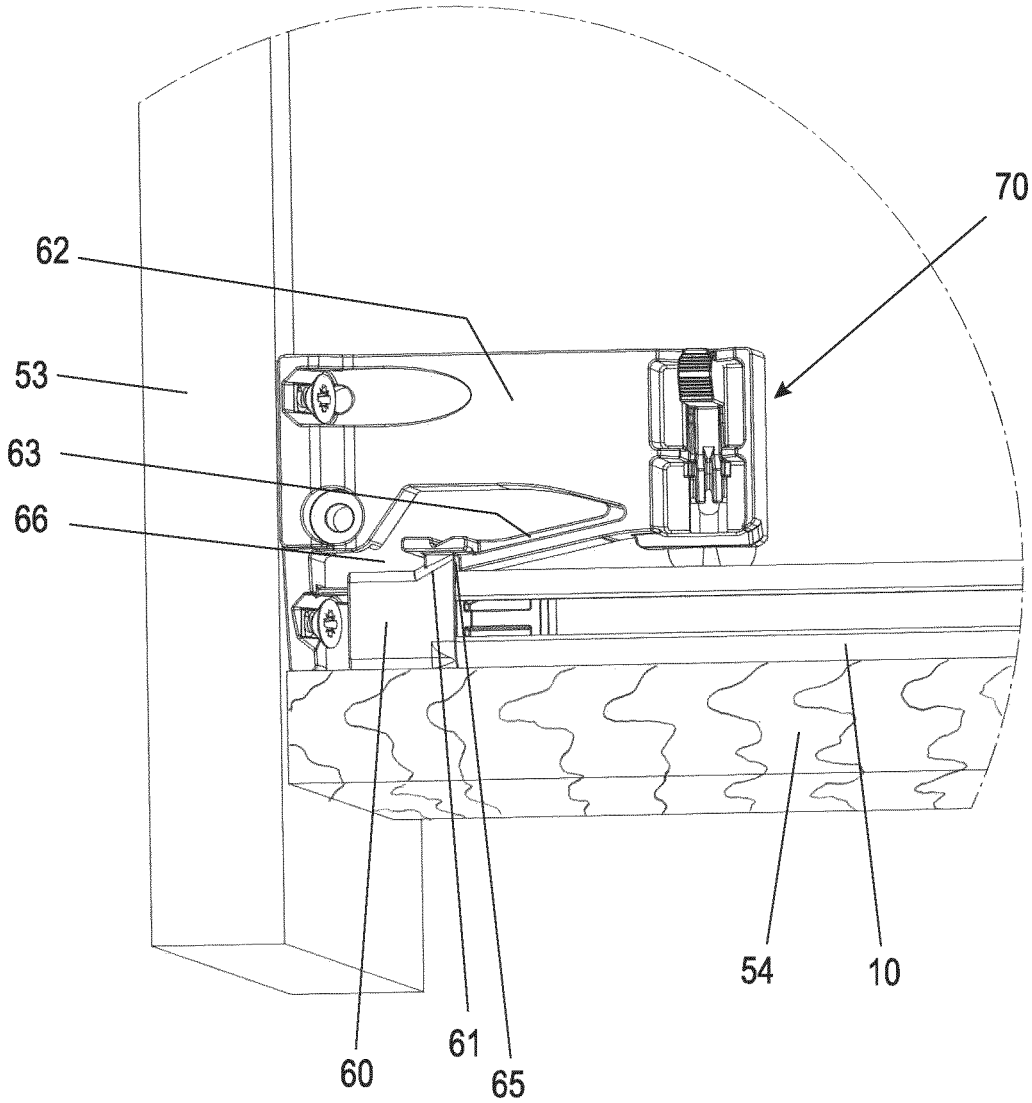
FIG. 15 shows a detailed view of the connecting means of FIG. 14 during assembly.

FIGS. 14 to 16 describe how to attach the pushing element 52 via the latching projection 61, which is formed on the plug 60. If the plug 60 is omitted, the pushing element 52 can also be attached via the latching projection 90, which is shown in FIG. 13. On the "inside" of rail 10 there are therefore two attaching means in the form of latching projections 61 or 90, and the pushing element 52 can be attached either to the integrally formed attaching means in the form of the latching projection 90 or to the attaching means on the plug 60.

Figure 17A:
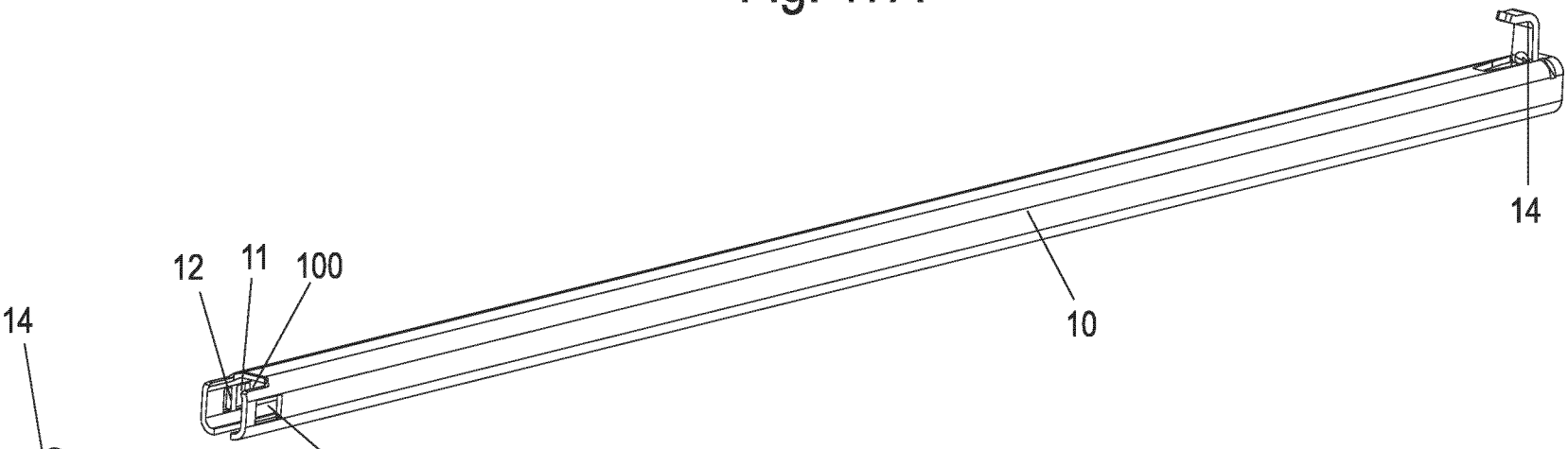
FIGS. 17A and 17B show two views of a rail of a pull-out guide according to another exemplary embodiment.
Figure 17B:
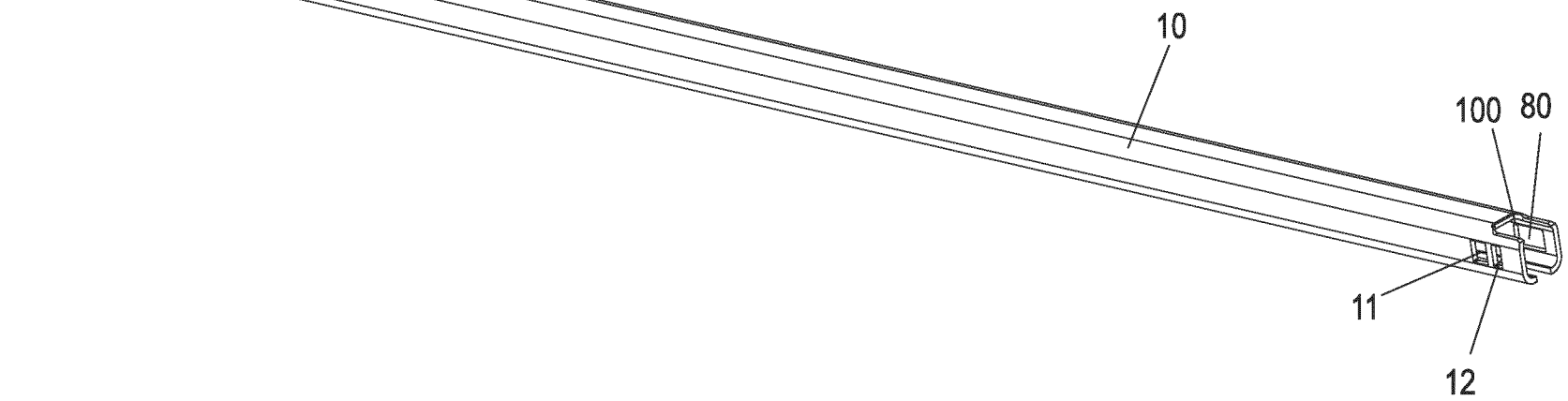

In FIGS. 17A and 17B, rail 10 is shown in two views. Rail 10 is made of a metal sheet and comprises two legs on opposite sides, wherein one leg is provided with the two latch receivers 11 and 12 and the other with a further latch receiver 80 in the form of a recess on the opposite side, which can be used as an alternative for attaching a second pushing element with a different connection interface to the first pushing element. The latch receiver 11 forms a first attaching means for attaching a first pushing element, while the latch receiver 80 is a second attaching means for attaching a second pushing element. Several latch receivers 80 can also be present. Instead of a latch receiver 80, a latching projection 90 can also be formed on the rail 10, as described above. In the front area, rail 10 has a channel 100, which is U-shaped with two vertical legs and an upper opening, and which, when mounted, allows the pushing element to be removed without tools by lifting it upwards. In order to prevent this lifting upwards from occurring unintentionally, at least one vertical leg, preferably both vertical legs, of the channel 100 can have an edge at the upper end which is directed into the channel as an undercut, which causes a certain resistance to lifting upwards, which must first be overcome when the channel is lifted intentionally. In the assembled state, for example, the web 67 of connecting means 62 shown in FIG. 14 engages with channel 100.

Figure 18A:
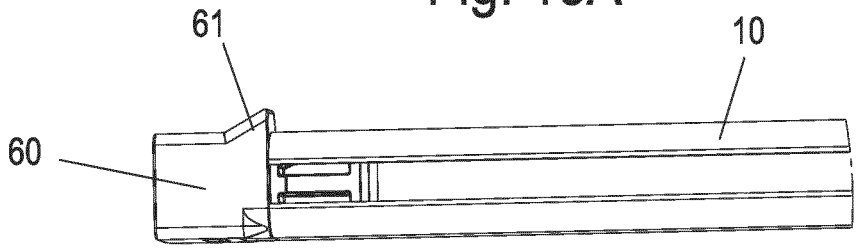
FIGS. 18A to 18E show several views of an end section of a rail of a pull-out guide according to two further exemplary embodiments.
Figure 18B:
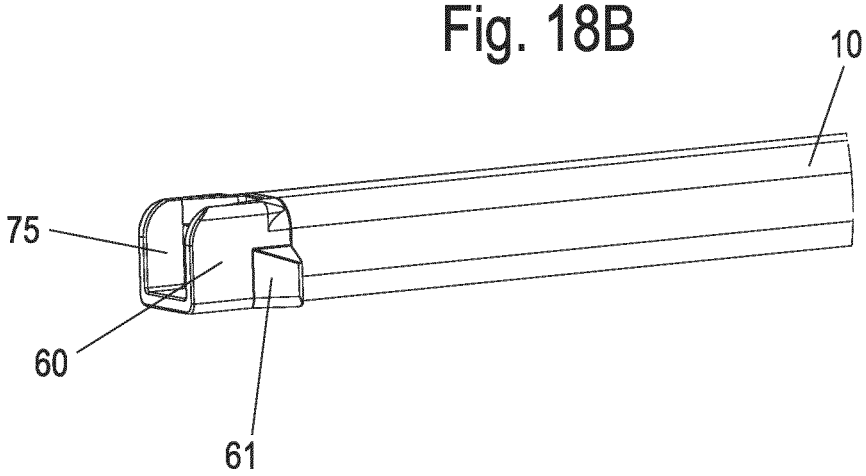
Figure 18C:
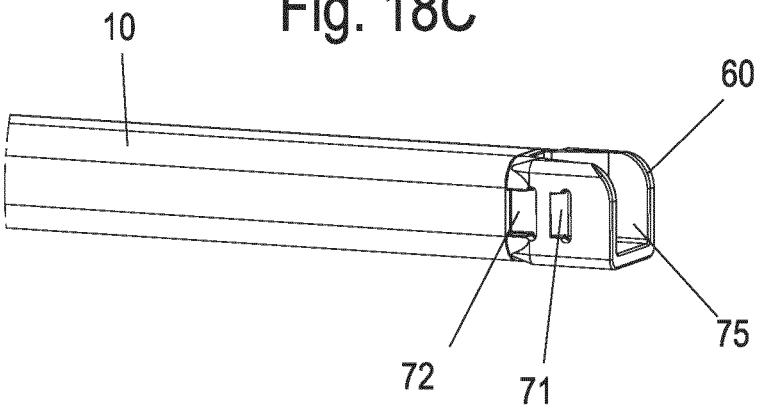
Figure 18D:
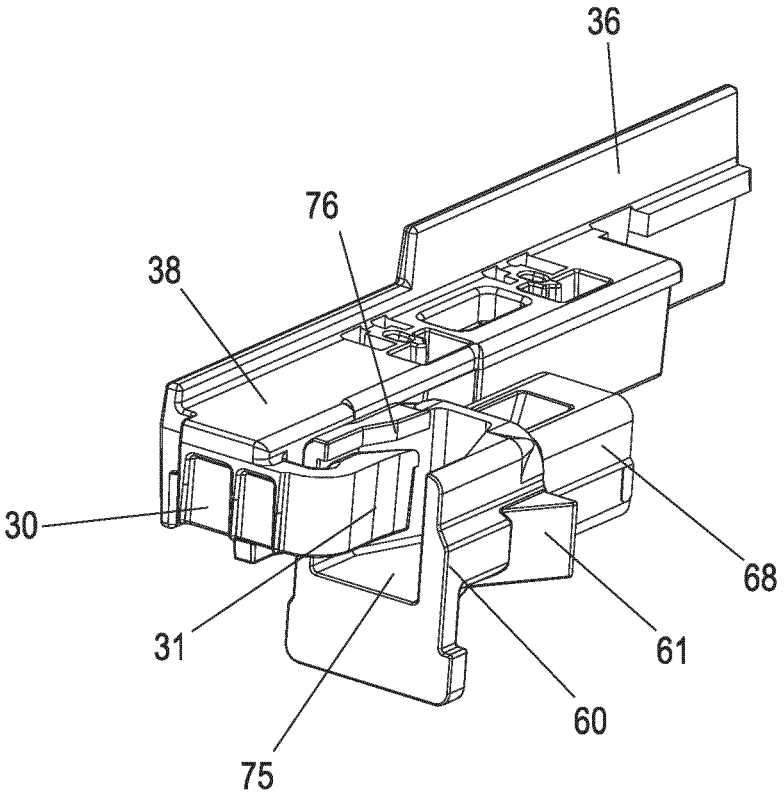

In FIGS. 18A to 18C, an end section of rail 10 is shown in several views. Rail 10 is fitted with a plug 60 at the end, with a latching projection 61 protruding from the side. On the opposite side to the latching projection 61, two latch receivers 71 and 72 are formed on the plug 60, which are similar in shape to the latch receivers 11 and 12 explained in FIGS. 1 to 8. A pushing element 3 can also be attached via the latching projection 22 and the latch receivers 11 and 12 on the plug 60, on which corresponding latch receivers 71 and 72 are formed. The plug 60 is provided with a channel 75, which is U-shaped with two vertical legs and an upper opening. This allows the pushing element 3 to be lifted upwards for disassembly, as shown in FIG. 8. In order to prevent this upward lifting from occurring unintentionally, an edge 76 directed into the channel 75 can be formed as an undercut on at least one vertical leg, preferably on both vertical legs, of the channel 75 at the upper end, which represents a certain resistance against upward lifting which needs to be overcome in the case of intended lifting. In the assembled state, for example, the web 67 of connecting means 62 shown in FIG. 14 engages with channel 75. An edge 76 as an undercut is shown in FIG. 18D.

Figure 18E:
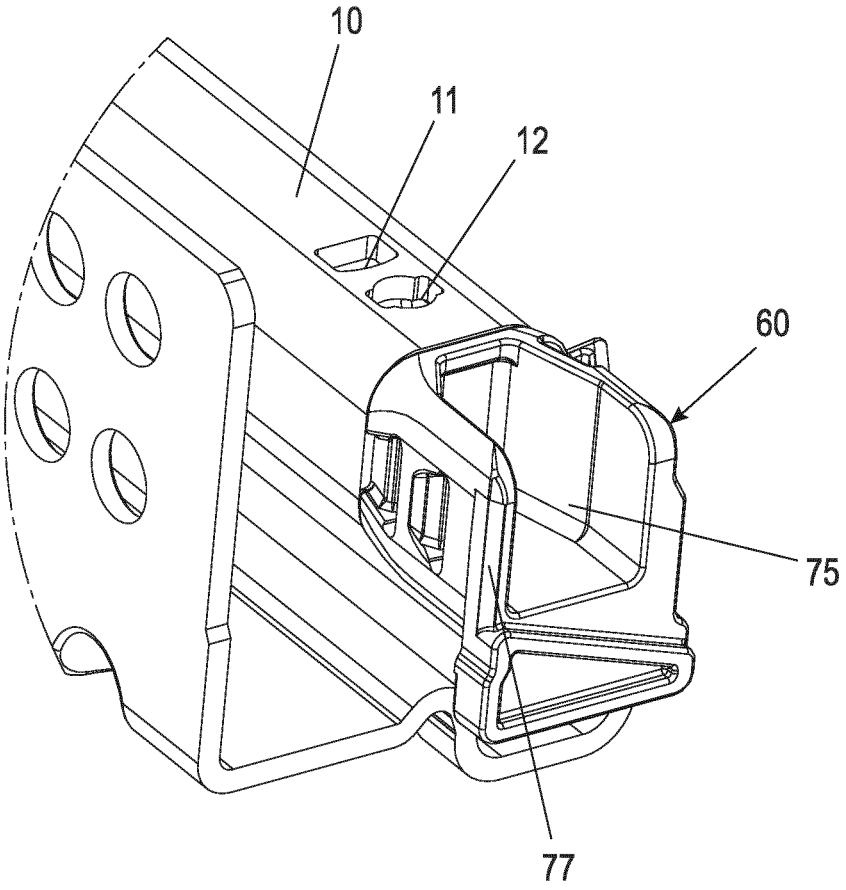
Figure 19B:
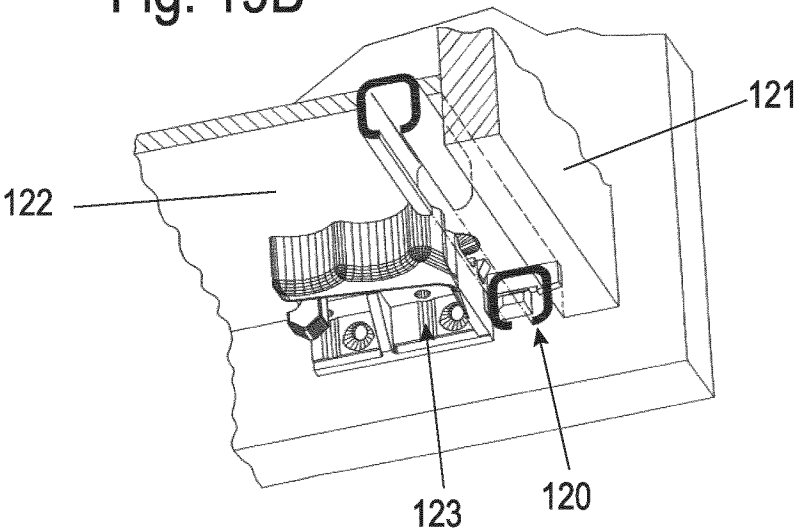
FIGS. 19A to 19D show schematic diagrams of different drawer systems.
Figure 19D:
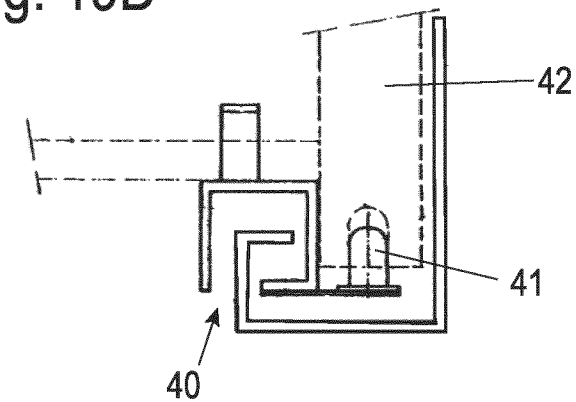
Figure 19A:
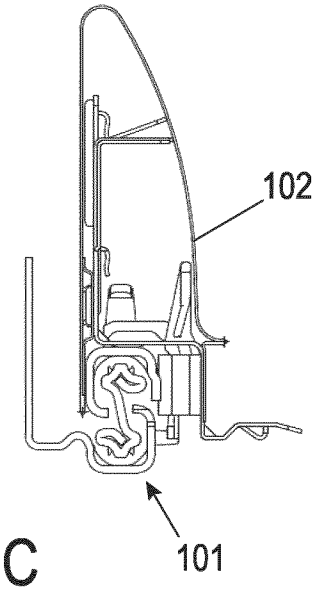
Figure 19C:
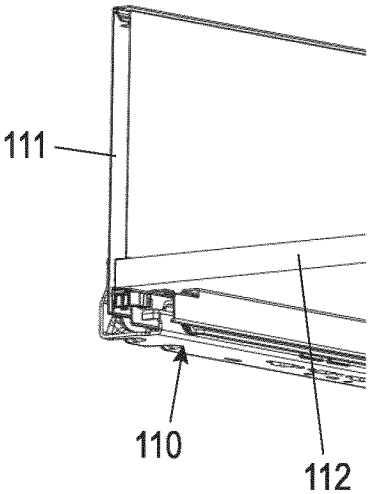

A slightly modified design of plug 60 is shown in FIG. 18E. In addition, plug 60 has a guide bevel 77 on at least one wall of channel 75, preferably on the two opposite walls. The guide bevel 77 widens towards the rear when viewed from the front so that it provides a guiding aid when a drawer is fitted. The plug 60 can be fixed in place via the latch receivers 11 and 12.

The plug 60 thus forms first and second attaching means to attach either the pushing element 3 or the pushing element 52, in this way, a single pull-out guide 8 with a rail 10 and the plug 60 can be used to fix different pushing elements. If the plug 60 is omitted, the first and second attaching means can also be formed integrally with the rail 10, for example in the form of latch receivers 11 and 12 or a latching projection 90. The first attaching means can also be arranged on the plug 60 and the second attaching means on the rail 10 or vice versa.

The first and second attaching means can be either the same or different in design and are used to mount either a first pushing element or a second pushing element to the rail 10, preferably without tools, without having to make any modifications to the rail 10.

LIST OF REFERENCE NUMERALS

1 Piece of furniture
2 Furniture body
3 Pushing element
4 Front panel
5 Base
6 Side frame
8 Pull-out guide
9 Guide rail
10 Rail
11 Latch receiver
12 Latch receiver
13 End
14 Hook
15 Plug
16 Section
17 Latching projection
18 Web
19 Spring element
20 Adapter
21 Contact surface

22 Latching projection
23 Slot
24 Slot
25 Spring web
26 Receptacle
27 Recess
30 Holder
31 Arm
32 Receptacle
33 Block
34 Counterholder
35 Support section
36 Wall section
37 Projection
38 Web
39 Opening
40 Pull-out guide
41 Pin
42 Drawer
45 Self-closing mechanism
46 Guide element
47 Driver
48 Activator
49 Cartridge
50 Piece of furniture
51 Furniture body
52 Pushing element
53 Front panel
54 Side wall
55 Base
56 Rear wall
60 Plug
61 Latching projection
62 Connecting means
63 Spring web
64 Guide bevel
65 Latch receiver
66 Latch receiver
67 Web
70 Adjusting means
71 Latch receiver
72 Latch receiver
75 Channel
76 Edge
77 Guide bevel
80 Latch receiver
90 Latching projection
100 Channel
101 Pull-out guide
102 Frame
110 Pull-out guide
111 Frame
112 Base
120 Pull-out guide
121 Frame
122 Drawer base
123 Coupling unit

What is claimed is:

1. A pull-out guide (8) having at least two rails movable relative to one another, wherein a first attaching means configured for attaching a pushing element of a first drawer system (3) is provided on a movable rail (10) of the two rails, wherein a second attaching means configured for attaching a pushing element of a second drawer system (52) is provided on the movable rail (10), the second attaching means being spaced from the first attaching means, and wherein the pushing element of either the first drawer system or the second drawer system (3, 52) can be fastened to the movable rail (10), wherein the first and second pushing elements (3, 52) are constructed as drawers which differ from one another at least in a region of side frames (6, 54) and/or have different connecting means (20, 62), and wherein the first drawer system is an underfloor drawer system and the second drawer system is a push-on drawer system or a system drawer system or an underfloor system drawer system.

2. The pull-out guide according to claim 1, wherein the first and second attaching means are arranged on opposite sides of the movable rail (10).

3. The pull-out guide according to claim 1, wherein the first pushing element (3) has a connecting interface with first connecting means (20) which is non-detachably connected to the pushing element (3).

4. The pull-out guide according to claim 1, wherein the second pushing element (52) has a connecting interface with second connecting means (62) detachably connected to the pushing element (52).

5. The pull-out guide according to claim 4, wherein at least one adjusting device is provided for adjusting the pushing element (52) relative to the movable rail (10) in at least one spatial direction.

6. The pull-out guide according to claim 1, wherein the first and second attaching means comprise at least one projection formed integrally with the movable rail (10).

7. The pull-out guide drawer assembly according to claim 1, wherein the first and second attaching means comprise at least one recess in the movable rail (10).

8. The pull-out guide drawer assembly according to claim 1, wherein the first and second attaching means are differently designed.

9. The pull-out guide according to claim 1, wherein an add-on part in the form of a plug (60) engaging at least partially in the movable rail, is provided on the movable rail (10), on which the first and/or second attaching means are formed.

10. The pull-out guide according to claim 9, wherein the movable rail (10) or the plug (60) has a channel (75, 100) in a front area, which allows the pushing element to be removed without tools.

11. The pull-out guide according to claim 1, wherein the pull-out guide has at least one vertical pin in a front region of the pull-out guide for receiving the push-on drawer system.

12. The pull-out guide according to claim 1, wherein the second drawer system is a system drawer system and wherein the system drawer system comprises a frame with a cavity into which at least part of the pull-out guide projects, wherein a connecting element is arranged in a front region of the cavity of the frame in order to connect the frame to the attaching means of the pull-out guide.

13. The pull-out guide according to claim 1, wherein the underfloor system drawer system has a frame and a base, in which the frame is arranged laterally next to the pull-out guide and the base is arranged above the pull-out guide, wherein a connecting element is arranged on the frame in a front region of the frame in order to connect the frame to the attaching means of the pull-out guide.

14. The pull-out guide according to claim 1, wherein the underfloor drawer system has a frame and a base, in which the frame is arranged laterally next to the pull-out guide and the base is arranged above the pull-out guide, wherein a separately mountable coupling unit is arranged on the underfloor drawer system in the front region below the drawer base, which unit establishes the connection with the attaching means of the pull-out guide.

* * * * *